United States Patent [19]

Iijima

[11] Patent Number: 5,070,066

[45] Date of Patent: Dec. 3, 1991

[54] PRESSURE SENSITIVE REPRODUCING MATERIAL

[75] Inventor: Zenshiro Iijima, Abiko, Japan

[73] Assignee: Adger Kogyo Co., Ltd., Soka, Japan

[21] Appl. No.: 352,612

[22] Filed: May 16, 1989

Related U.S. Application Data

[63] Continuation of Ser. No. 103,693, Oct. 2, 1987, abandoned.

[30] Foreign Application Priority Data

Oct. 8, 1986 [JP] Japan ..... 61-240070

[51] Int. Cl.[5] ..... B41M 5/14

[52] U.S. Cl. ..... 503/201; 503/209; 503/220; 503/224

[58] Field of Search ..... 106/21; 427/151; 503/209, 220, 224, 225, 201

[56] References Cited

U.S. PATENT DOCUMENTS

| | | | |
|---|---|---|---|
| 4,203,619 | 5/1980 | Sanders | 106/21 X |
| 4,254,971 | 3/1981 | Isaac | 428/330 X |
| 4,441,928 | 4/1984 | Iijama | 106/21 |

FOREIGN PATENT DOCUMENTS

| | | | |
|---|---|---|---|
| 0014216 | 8/1980 | European Pat. Off. | 106/21 |
| 252604 | 10/1912 | Fed. Rep. of Germany | 106/21 |
| 673695 | 4/1930 | France | 106/21 |
| 0226576 | 11/1985 | Japan | 503/201 |
| 2074943A | 11/1981 | United Kingdom | 503/201 |

*Primary Examiner*—Bruce H. Hess

*Attorney, Agent, or Firm*—Cushman, Darby & Cushman

[57] ABSTRACT

The object of the present invention is to provide a pressure sensitive reproducing material which allows reproduced letters or patterns to fade away automatically with the passage of time.

The present invention accomplished the object by a pressure sensitive reproducing material composed of a colored material supported on a substrate, in which the colored material comprises a phthalein group indicator which is color-developed by an inorganic weakly basic substance jointly used with an organic amine and contains hygroscopic material or drying inhibitor.

3 Claims, No Drawings

PRESSURE SENSITIVE REPRODUCING MATERIAL

This is a continuation of application Ser. No. 07/103,693, filed Oct. 2, 1987, which was abandoned upon the filing hereof.

FIELD OF THE INVENTION

The present invention relates to a pressure sensitive reproducing material useful for providing reproduced letters or patterns which fade away automatically with the passage of time.

DESCRIPTION OF THE PRIOR ART

Pressure sensitive reproducing materials such as carbon paper in which pigments are applied on substrates of paper or plastic film are already known.

With such reproducing materials, desired letters or patterns can be reproduced pressure-sensitively using a pressure-applying tool such as ball-point pen, stylus or roulette on a sheet of paper, cloth or the like placed under the reproducing material.

The reproduced letters or patterns usually do not fade away, and it is rather difficult to erase them in the case they become unnecessary. For example, in such works as sewing, embroidery or lettering, letters or patterns are drafted using conventional reproducing materials, and the drafted letters or patterns are to be erased at the end of works. The erasing is usually carried out using a rubber eraser or the like, however, the operation is rather troublesome.

An erasable ink composition comprising an indicator of the phthalein series, an inorganic weakly basic substance and an organic amine which can be used as an ink for a sign-pen, is disclosed by the present inventor in U.S. Pat. No. 4,441,928. However, such aqueous ink composition cannot be used properly for reproduction purposes.

SUMMARY OF THE INVENTION

The object of the present invention is to provide a pressure sensitive reproducing material which allows reproduced letters or patterns to fade away automatically with the passage of time.

The present invention accomplished the object by a pressure sensitive reproducing material composed of a colored material supported on a substrate, in which the colored material comprises a phthalein group indicator which is color-developed by an inorganic weakly basic substance jointly used with an organic amine and contains hygroscopic material or drying inhibitor.

DETAILED DESCRIPTION OF THE PREFERRED EMBODIMENTS

The present invention provides an improved pressure sensitive reproducing material composed of a colored material supported on a substrate, in which the colored material comprises a phthalein group indicator which is color-developed by an inorganic weakly basic substance jointly used with an organic amine and contains hygroscopic material or drying inhibitor.

The phthalein group indicator which can be used in the present invention includes, for example, alpha-naphtholphthalein, p-cresolphthalein, o-cresolphthalein, phenolphthalein, thymolphthalein, xylenolphthalein, dibromophenol-tetrabromophenyl-sulfonphthalein and nitrophenol-sulfonphthalein. All these compounds develop color on the alkaline pH side and are color-less on the acidic pH side.

One component employed for the color-development of the above mentioned phthalein group indicator is an inorganic weakly basic substance, which is preferred in contrast with such a strong alkaline or basic substance as sodium hydroxide and potassium hydroxide. Exemplary weakly basic substance are such alkali carbonates as sodium carbonate and potassium carbonate, such alkali sulfites as sodium sulfite and potassium sulfite, such alkali hydrogenphosphates as sodium hydrogenphosphate and potassium hydrogenphosphate, and such alkali salts of acetic acid as sodium acetate and potassium acetate.

Organic amines jointly used with the above weakly basic substance are liquid at ambient temperature, and include such aliphatic primary amines as amylamine and monoethanolamine, such aliphatic secondary amines as diethylamine and dipropylamine and such aliphatic tertiary amines as triethanolamine and triethylamine. These amines can be employed individually or as a mixture in accordance with the desired tone of color.

When such an inorganic weakly basic substance as an alkali carbonate is used alone as the color-developing agent, brightness of the color developed is usually low. However, the tone of color is improved by the joint use of the organic amine with the weakly basic substance.

On the other hand, when such a strongly alkaline substance as sodium hydroxide is employed, the phthalein group indicator suffers change in its molecular structure and being converted to colorless when stored, and the object of the invention is hardly achieved.

A drying inhibitor or a hygroscopic agent such as glycerine, alkylene glycol, polyalkyleneglycol and the like must be added to improve the shelf life of the reproducing material. Further, such water-soluble macromolecular substances as polyvinylalcohol, starch, sodium alginate and carboxymethyl-cellulose may be added as a binder, if desired.

Pressure sensitive reproducing material of the present invention can be prepared by dipping a substrate in an aqueous ink-like composition comprising the phthalein group indicator, the inorganic weakly basic substance, the organic amine and hygroscopic material or drying inhibitor, then drying it. Reproducing material of the present invention can also be prepared by daubing or spraying the aqueous ink-like composition and drying it. In this case, the aqueous ink-like composition can be applied on one side or on both sides of the substrate.

The preferable aqueous ink-like composition comprises 0.1–10%, preferably 0.5–3% by weight of the phthalein group indicator, 0.5–20%, preferably 3–10% by weight of the inorganic weakly basic substance, 0.5–20%, preferably 3–10% by weight of the organic amine and 5–80%, preferably 20–60% by weight of the drying inhibitor or hygroscopic agent in the composition.

Such materials as paper, cloth, hygroscopic rubber, plastic sheet or film are used as the substrate.

When a sheet of paper or a piece of cloth is placed under the reproducing material, and pressure is applied using a pencil or a ball-point pen etc. on the surface of the substrate, desired letters or patterns are reproduced on the paper or the cloth. The letters and patterns thus reproduced fade away automatically with the passage of time as a result of being exposed in the atmosphere.

Accordingly, the reproducing material of the present invention is especially suitable for drafting letters and patterns in the field of sewing, embroidery, lettering and the like.

The present invention will be explained in detail hereunder using examples.

EXAMPLE 1

Into 50 milliliters of water, were dissolved successively 5.5 grams of anhydrous sodium carbonate and 1 gram of orthocresolphthalein, and further were added 10 milliliters of triethanolamine and 40 milliliters of glycerine one after another to prepare a solution having a purple color. A sheet of blotting paper was dipped into the solution, and the dipped paper was dried to produce a reproducing material. On a sheet of paper and a piece of cloth was placed the reproducing material, and patterns were drawn on the surface of the reproducing material using a stylus to reproduce on the paper and the cloth purple colored patterns corresponding to those drawn. When the reproduced patterns were exposed in the atmosphere, they faded away after 10–40 hours for the paper and 4–7 days for the cloth.

EXAMPLE 2

Into 50 milliliters of water, were dissolved successively 4 grams of anhydrous sodium carbonate and 1 gram of phenylphthalein, and further were added 10 milliliters of triethanolamine, 20 milliliters of glycerin and 20 milliliters of polyethyleneglycol (M.W. 200) one after another to prepare a solution having a reddish-purple color. A sheet of paper was dipped into the solution, and the dipped paper was dried to prepare a reproducing material. On a piece of cloth and a sheet of paper was placed the reproducing material and reproduction was performed using a roulette to reproduce on the cloth and paper reddish-purple colored patterns corresponding to those drawn. When the patterns were exposed in the atmosphere, patterns faded after 20–24 hours for the paper and 24–70 hours for the cloth.

EXAMPLE 3

Into 42 milliliters of water, were dissolved successively 8 grams of sodium acetate and 0.8 grams of alpha-naphtholphthalein, and further were added 8 milliliters of triethanolamine, 30 milliliters of glycerin and 20 milliliters of polyethyleneglycol (M.W. 200) to prepare a mixture solution having blue color. A sheet of paper was dipped into the solution, and the dipped paper was dried to prepare a reproducing material. On a piece of cloth and a sheet of paper was placed the reproducing material and reproduction was performed using a roulette to reproduce on the cloth and paper blue colored patterns corresponding to those drawn. When the patterns were exposed in the atmosphere, patterns faded after 10–50 hours for the paper and 4–8 days for the cloth.

EXAMPLE 4

Into 42 milliliters of water, were dissolved successively 8 grams of sodium acetate and 0.5 grams of alpha-naphtholphthalein, and further were added 8 milliliters of diethylamine and 50 milliliters of of glycerin to prepare a mixture solution having blue color. A sheet of paper was dipped into the solution, and the dipped paper was dried to prepare a reproducing material. On a piece of cloth and a sheet of paper was placed the reproducing material and reproduction was performed using a roulette to reproduce on the cloth and paper blue colored patterns corresponding to those drawn. When the patterns were exposed in the atmosphere, patterns faded after 10–50 hours for the paper and 4–8 days for the cloth.

EXAMPLE 5

Into 35 milliliters of water, were dissolved successively 10 grams of sodium phosphate and then 1 gram of alpha-naphtholphthalein, and further were added 15 milliliters of monoethanolamine, 15 milliliters of polyethyleneglycol (M.W. 200) and 35 milliliters of glycerin to prepare a mixture solution having blue color. A sheet of paper was dipped into the solution, and the dipped paper was dried to produce a reproducing material. On a sheet of paper and a piece of cloth was placed the reproducing material, and patterns were drawn on the surface of the reproducing material using a roulette to reproduce on the paper and the cloth blue colored patterns corresponding to those drawn. When the reproduced patterns were exposed in the atmosphere, they faded away after 10–50 hours for the paper and 4–8 days for the cloth.

EXAMPLE 6

Into 35 milliliters of water, were dissolved successively 10 grams of sodium acetate and 0.8 grams of orthocresolphthalein, and further were added 15 milliliters of monoethanolamine and 50 milliliters of glycerin to prepare a mixture solution in purple color. A sheet of paper was dipped into the solution, and the dipped paper was dried to prepare a reproducing material. On a piece of cloth and a sheet of paper was placed the reproducing material and reproduction was performed using a roulette to reproduce on the cloth and paper purple colored patterns corresponding to those drawn. When the patterns were exposed in the atmosphere, patterns faded after 10–40 hours for the paper and 4–7 days for the cloth.

EXAMPLE 7

Into 50 milliliters of water, were dissolved successively 8 grams of sodium phosphate and 1 gram of orthocresolphthalein, and further were added 10 milliliters of diethylamine and 40 milliliters of glycerin to prepare a mixture solution in purple color. A sheet of paper was dipped into the solution, and the dipped paper was dried to prepare a reproducing material. On a piece of cloth and a sheet of paper was placed the reproducing material and reproduction was performed using a roulette to reproduce on the cloth and paper purple colored patterns corresponding to those drawn. When the patterns were exposed in the atmosphere, patterns faded after 10–40 hours for the paper and 4–7 days for the cloth.

EXAMPLE 8

Into 50 milliliters of water, were dissolved successively 7 grams of sodium acetate and 1.2 grams of phenolphthalein, and further were added 10 milliliters of diethylamine and 40 milliliters of glycerin to prepare a mixture solution in reddish-purple color. A sheet of paper was dipped into the solution, and the dipped paper was dried to prepare a reproducing material. On a piece of cloth and a sheet of paper was placed the reproducing material and reproduction was performed using a roulette to reproduce on the cloth and paper reddish-purple colored patterns corresponding to those drawn. When the patterns were exposed in the atmosphere, patterns faded after 20–24 hours for the paper and 24–70 hours for the cloth.

EXAMPLE 9

Into 50 milliliters of water, were dissolved successively 10 grams of sodium phosphate and 0.8 grams of phenolphthalein, and further were added 15 milliliters of monoethanolamine and 40 milliliters of glycerin to prepare a mixture solution in reddish-purple color. A sheet of paper was dipped into the solution, and the dipped paper was dried to prepare a reproducing material. On a piece of cloth and a sheet of paper was placed the reproducing material and reproduction was performed using a roulette to reproduce on the cloth and paper reddish-purple colored patterns corresponding to those drawn. When the patterns were exposed in the atmosphere, patterns faded after 20–24 hours for the paper and 24–70 hour days for the cloth.

I claim:

1. A method of drawing erasable letters and/or patterns on a piece of cloth or paper comprising the following steps:

1) placing the piece of cloth or paper underneath a pressure sensitive reproducing material composed of a substrate and a colored material supported on said substrate wherein the colored material includes a) a phthalein group indicator b) an inorganic weakly basic substance and an organic amine and c) a hygroscopic material or a drying inhibitor, said phthalein group indicator being color-developed by said inorganic weakly basic substance and said organic amine; and 2) applying a pressure with a pressure applying tool on the surface of the pressure sensitive reproducing material at desired places.

2. A method of drawing erasable letters and/or patterns on a piece of cloth or paper according to claim 1, wherein the content by weight of the phthalein group indicator is 0.1–10%, the inorganic weakly basic substance is 0.5–20%, the organic amine is 0.5–20% and the drying inhibitor or hygroscopic material is 5–80%.

3. A method of drawing erasable letters and/or patterns on a piece of cloth or paper according to claim 1, wherein the substrate is selected from the group consisting of paper, cloth, hygroscopic rubber, and plastic film.

* * * * *